US012577632B2

(12) United States Patent
Jung

(10) Patent No.: US 12,577,632 B2
(45) Date of Patent: Mar. 17, 2026

(54) HIGH-STRENGTH WIRE ROD HAVING HIGH HYDROGEN EMBRITTLEMENT RESISTANCE FOR COLD HEADING, AND METHOD FOR MANUFACTURING THE SAME

(71) Applicant: POSCO CO., LTD, Pohang-si (KR)

(72) Inventor: Byung-In Jung, Gyeongsangbuk-do (KR)

(73) Assignee: POSCO CO., LTD, Pohang-si (KR)

( * ) Notice: Subject to any disclaimer, the term of this patent is extended or adjusted under 35 U.S.C. 154(b) by 486 days.

(21) Appl. No.: 17/783,369

(22) PCT Filed: Dec. 16, 2020

(86) PCT No.: PCT/KR2020/018459
§ 371 (c)(1),
(2) Date: Jun. 8, 2022

(87) PCT Pub. No.: WO2021/125793
PCT Pub. Date: Jun. 24, 2021

(65) Prior Publication Data

US 2023/0029137 A1 Jan. 26, 2023

(30) Foreign Application Priority Data

Dec. 17, 2019 (KR) ..... 10-2019-0169215

(51) Int. Cl.
*C21D 9/52* (2006.01)
*C21D 8/06* (2006.01)
(Continued)

(52) U.S. Cl.
CPC ..... *C21D 9/525* (2013.01); *C21D 8/065* (2013.01); *C22C 38/02* (2013.01); *C22C 38/04* (2013.01);
(Continued)

(58) Field of Classification Search
CPC .. C21D 9/525; C21D 8/065; C21D 2211/002; C21D 2211/008; C21D 2211/009;
(Continued)

(56) References Cited

U.S. PATENT DOCUMENTS

2003/0150529 A1* 8/2003 Uno ..... C22C 38/24 148/334
2005/0217763 A1 10/2005 Ahn
(Continued)

FOREIGN PATENT DOCUMENTS

CN 1668773 A 9/2005
CN 107794441 A 3/2018
(Continued)

OTHER PUBLICATIONS

Machine Translation of WO-2014163431-A1 (Year: 2014).*
(Continued)

*Primary Examiner* — Adil A. Siddiqui
(74) *Attorney, Agent, or Firm* — Morgan Lewis & Bockius LLP

(57) ABSTRACT

Provided are a high-strength wire rod having high hydrogen embrittlement resistance for cold heading, and a method for manufacturing the high-strength wire rod. The high-strength wire rod for cold heading has a chemical composition including, by weight %, C: 0.3% to 0.5%, Si: 0.01% to 0.3%, Mn: 0.3% to 1.0%, Cr: 0.5% to 1.5%, Mo: 0.5% to 1.5%, V: 0.01% to 0.4%, and a balance of Fe and other impurities, and the chemical composition satisfies the relational expression 1. The high-strength wire rod for cold heading has a microstructure including, by area %, 1% to 15% martensite, 0.1% to 5% pearlite, and a balance of bainite, and the fraction of martensite formed along grain boundaries of prior austenite in the martensite of the microstructure is 60% or more.

2 Claims, 1 Drawing Sheet

(51) Int. Cl.

| | |
|---|---|
| ***C22C 38/02*** | (2006.01) |
| ***C22C 38/04*** | (2006.01) |
| ***C22C 38/22*** | (2006.01) |
| ***C22C 38/24*** | (2006.01) |

(52) U.S. Cl.
CPC ..... *C22C 38/22* (2013.01); *C22C 38/24* (2013.01); *C21D 2211/002* (2013.01); *C21D 2211/008* (2013.01); *C21D 2211/009* (2013.01)

(58) Field of Classification Search
CPC ... C21D 1/02; C21D 1/25; C21D 1/58; C21D 1/84; C21D 7/10; C21D 9/68; C21D 8/0226; C22C 38/02; C22C 38/04; C22C 38/22; C22C 38/24
See application file for complete search history.

(56) References Cited

U.S. PATENT DOCUMENTS

| | | | | |
|---|---|---|---|---|
| 2007/0017609 | A1* | 1/2007 | Kubota | C22C 38/02 148/654 |
| 2018/0016658 | A1* | 1/2018 | Okonogi | C21D 6/002 |
| 2021/0324493 | A1 | 10/2021 | Jung et al. | |

FOREIGN PATENT DOCUMENTS

| | | | | |
|---|---|---|---|---|
| EP | 3385400 | A1 | 10/2018 | |
| JP | H07-268545 | A | 10/1995 | |
| JP | H07-300651 | A | 11/1995 | |
| JP | H09-78193 | A | 3/1997 | |
| JP | 2011-047010 | A | 3/2011 | |
| JP | 2013-237903 | A | 11/2013 | |
| KR | 10-2001-0060772 | A | 7/2001 | |
| KR | 10-0428581 | B1 | 4/2004 | |
| KR | 10-0723186 | B1 | 5/2007 | |
| KR | 10-2007-0068511 | A | 7/2007 | |
| KR | 10-0833079 | B1 | 5/2008 | |
| KR | 10-2019-0074779 | A | 6/2019 | |
| KR | 10-2019-0074824 | A | 6/2019 | |
| KR | 10-2019-0078129 | A | 7/2019 | |
| KR | 10-2020-0025713 | A | 3/2020 | |
| WO | WO-2014163431 | A1 * | 10/2014 | B21K 1/44 |
| WO | 2018/230717 | A1 | 12/2018 | |

OTHER PUBLICATIONS

Suresh, M.R. 0.3C—CrMoV(ESR) Steel: A New Ultrahigh Strength Steel. Trans Indian Inst Met 64, 483-492 (2011) (Year: 2011).*
International Search Report dated Mar. 24, 2021 issued in International Patent Application No. PCT/KR2020/018459 (with English translation).
Chinese Office Action dated Mar. 1, 2023 issued in Chinese Patent Application No. 202080086532.5 (with English translation).
Extended European Search Report dated Feb. 14, 2023 issued in European Patent Application No. 20903707.6.

* cited by examiner

【Figure 1】
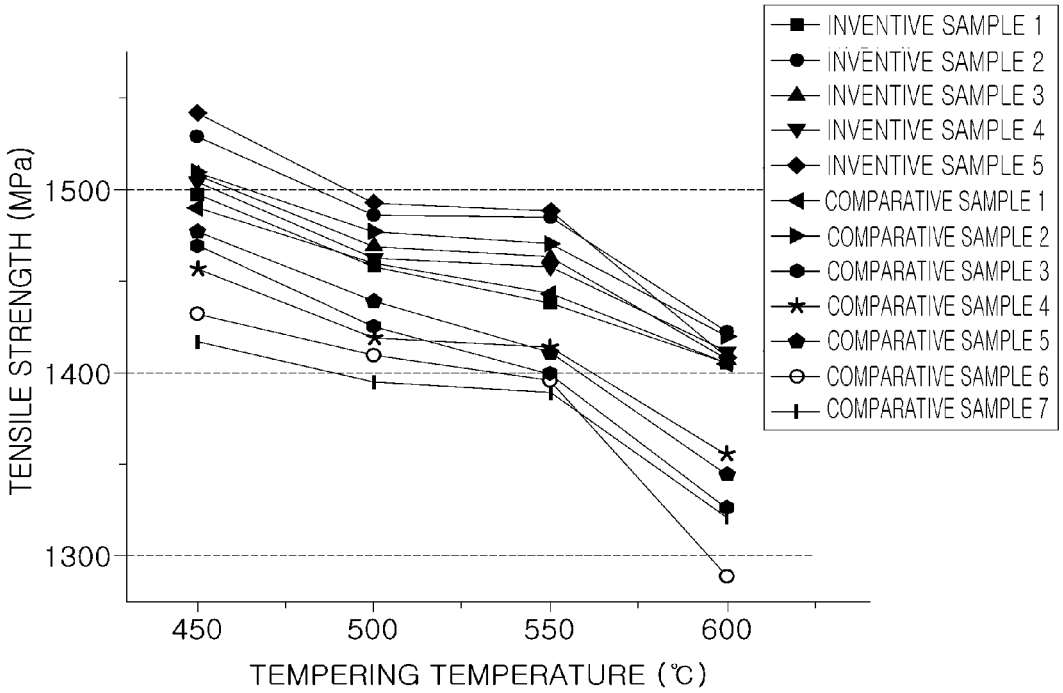
【Figure 2】
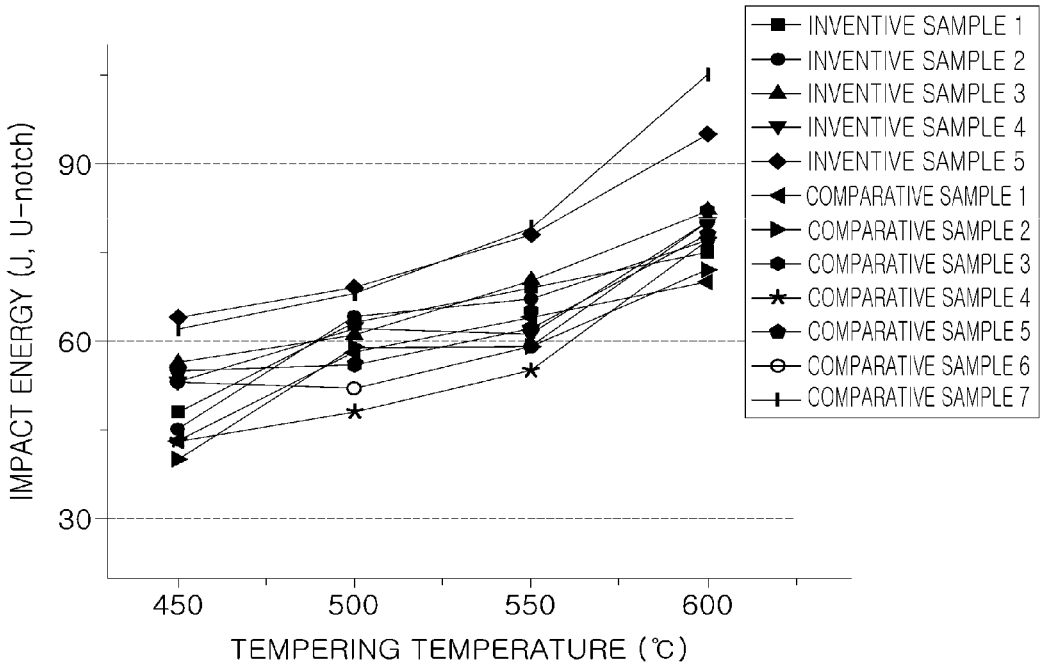

HIGH-STRENGTH WIRE ROD HAVING HIGH HYDROGEN EMBRITTLEMENT RESISTANCE FOR COLD HEADING, AND METHOD FOR MANUFACTURING THE SAME

CROSS-REFERENCE OF RELATED APPLICATIONS

This application is the U.S. National Phase under 35 U.S.C. § 371 of International Patent Application No. PCT/KR2020/018459, filed on Dec. 16, 2020, which in turn claims the benefit of Korean Application No. 10-2019-0169215, filed on Dec. 17, 2019, the entire disclosures of which applications are incorporated by reference herein.

TECHNICAL FIELD

The present disclosure relates to the manufacturing of a wire rod for cold heading which is used for mechanical structures and automobile parts, etc., and more particularly, to the manufacturing of a wire rod, a part, or the like by controlling the microstructure of a steel material as well as the composition of the steel material to improve the hydrogen delayed fracture resistance of a final product after QT heat treatment.

BACKGROUND ART

General wire rod products for cold heading are used to manufacture mechanical structures, automobile parts, or the like through cold drawing, spheroidizing heat treatment, cold drawing, cold heading, quenching, and tempering. Recent technical trends in developing steel materials for cold heading are to develop wire rods which enable the omission of heat treatment and machining and develop high-strength steel materials for cold heading which enable the production of lightweight automobile parts for complying with global fuel efficiency requirements.

For example, vehicle weight reduction is in progress to comply with global automobile fuel efficiency requirements for improving the atmospheric environment, and to this end, parts such as small, high-power engines have been developed. High-strength steel materials for cold heading are needed for manufacturing such small, high-power parts.

High-strength steel materials for cold heading may be quenched and tempered after a cold heading process. In this case, however, tempered martensite, which is a microstructure very sensitive to hydrogen delayed fracture at a high load condition of 1300 MPa or more, is formed, and thus it is difficult to use the high-strength steel materials. To address this, high-temperature tempering may be performed during QT heat treatment to form spheroidized carbides along the grain boundaries of prior austenite while preventing the formation of thin-film-shaped carbides, thereby improving resistance to hydrogen delayed fracture.

In this case, however, it is required to uniformly scatter and distribute the spheroidized carbides inside and outside the grain boundaries in order to effectively improve resistance to hydrogen delayed fracture. Thus, the development wire rods for cold heading, which satisfy this requirement, is needed.

DISCLOSURE

Technical Problem

An aspect of the present disclosure is to provide a high-strength wire rod having high resistance to hydrogen delayed fracture for cold heading and a method for manufacturing the high-strength wire rod.

Another aspect of the present disclosure is to provide a high-strength, high-toughness, heat-treated part manufactured using the wire rod, and a method for manufacturing the high-strength, high-toughness, heat-treated part.

Aspects of the present disclosure are not limited to the aspects described above. Those of ordinary skill in the art to which the present disclosure pertains will have no difficulty in understanding other aspects of the present disclosure from the detailed description of the present specification.

Technical Solution

According to an aspect of the present disclosure, a high-strength wire rod with high resistance to hydrogen delayed fracture for cold heading has a chemical composition including, by weight %, C: 0.3% to 0.5%, Si: 0.01% to 0.3%, Mn: 0.3% to 1.0%, Cr: 0.5% to 1.5%, Mo: 0.5% to 1.5%, V: 0.01% to 0.4%, and a balance of Fe and other impurities, and the chemical composition satisfies the relational expression 1 below, wherein the high-strength wire rod has a microstructure including, by area %, 1% to 15% martensite, 0.1% to 5% pearlite, and a balance of bainite, and a fraction of martensite formed along grain boundaries of prior austenite in the martensite of the microstructure is 60% or more, $$1.5Cr+2.89Mo+7V \geq 3.563 \quad \text{[Relational expression 1]}$$

where Cr, Mo, and V each refer to a content thereof in weight %.

According to an aspect of the present disclosure, there is provided a method for manufacturing a high-strength wire rod having high resistance to hydrogen delayed fracture for cold heading, the method including:

finish rolling a steel material at a temperature of 900° C. to 1100° C. to manufacture a hot-rolled steel material having an average austenite grain size of 30 μm or less, and coiling the hot-rolled steel material, wherein the steel material has a chemical composition including, by weight %, C: 0.3% to 0.5%, Si: 0.01% to 0.3%, Mn: 0.3% to 1.0%, Cr: 0.5% to 1.5%, Mo: 0.5% to 1.5%, V: 0.01% to 0.4%, and a balance of Fe and other impurities, and the chemical composition satisfies the relational expression 1 above;

cooling the coiled steel material at a cooling rate of 0.5° C./s to 1.0° C./s to manufacture a high-strength wire rod having high resistance to hydrogen delayed fracture for cold heading, wherein the high-strength wire rod has a microstructure including, by area %, 1% to 15% martensite, 0.1% to 5% pearlite, and a balance of bainite, and the fraction of martensite formed along grain boundaries of prior austenite in the martensite of the microstructure is 60% or more.

According to an aspect of the present disclosure, a high-strength heat-treated part with high resistance to hydrogen delayed fracture has a chemical composition including, by weight %, C: 0.3% to 0.5%, Si: 0.01% to 0.3%, Mn: 0.3% to 1.0%, Cr: 0.5% to 1.5%, Mo: 0.5% to 1.5%, V: 0.01% to 0.4%, and a balance of Fe and other impurities, and the chemical composition satisfies the relational expression 1 below:

$$1.5Cr+2.89Mo+7V \geq 3.563 \quad \text{[Relational expression 1]}$$

where Cr, Mo, and V each refer to a content thereof in weight %.

The high-strength heat-treated part has a tensile strength of 1400 MPa or more and an impact toughness of 60 J or more.

According to an aspect of the present disclosure, there is provided a method for manufacturing a high-strength heat-treated part having high resistance to hydrogen delayed fracture, the method including:

performing a softening heat treatment on a wire rod at a temperature of 700° C. to 800° C. to lower strength of the wire rod, the wire rod having the chemical composition and the microstructure described above;

manufacturing a part by cold forging the wire rod having a lowered strength and then heating the wire rod to a temperature of 850° C. to 1050° C.;

quenching the heated part by immersing the heated part in oil having a temperature of 40° C. to 70° C.; and manufacturing a heat-treated part having a tempered martensite microstructure by tempering the quenched part at a temperature of 500° C. to 650° C. for 5000 seconds to 10000 seconds.

Advantageous Effects

According to the present disclosure, a high-strength steel material having high resistance to hydrogen delayed fracture for cold heading is manufactured by controlling the composition of the steel material and also adjusting the fraction of martensite formed along the grain boundaries of prior austenite in the martensite of the microstructure of a wire rod to be 60% or more, thereby suppressing the formation of thin-film-shaped carbides mainly occurring along the grain boundaries of austenite during high-temperature tempering, scattering and distributing spheroidized carbides inside and outside the grain boundaries, and improving resistance to hydrogen delayed facture.

Therefore, according to the present disclosure, a final part obtained through heat treatment may have a tensile strength of 1400 MPa or more and an impact toughness of 60 J or more.

DESCRIPTION OF DRAWINGS

FIG. 1 is a graph illustrating the tensile strength of inventive samples and comparative samples with respect to tempering temperatures in an example of the present disclosure.

FIG. 2 is a graph illustrating the impact absorption energy of inventive samples and comparative samples with respect to tempering temperatures in the example of the present disclosure.

BEST MODE

Hereinafter, the present disclosure will be described.

The basic principle of the present disclosure is to reduce the content of Si, which is widely known as an element causing solid solution strengthening, as much as possible for securing cold forgeability, add Mo and V for preventing a strength decrease during a high-temperature tempering process at a temperature of 500° C. or more, and add V for grain refinement. In addition, the contents of Cr, Mo, and V are optimally controlled, and the microstructure of a wire rod is controlled, particularly, the fraction of martensite formed along the grain boundaries of prior austenite is adjusted to be 60% or more, thereby increasing the strength and the hydrogen delayed fracture resistance of a wire rod for cold heading.

In addition, softening heat treatment, cold forging, and QT heat treatment are performed on a wire rod manufactured as described above to prevent the formation of thin-film-shaped carbides along the grain boundaries of prior austenite and scatter and distribute spheroidized carbides inside and outside the grain boundaries, thereby improving resistance to delayed hydrogen fracture. The present disclosure is provided based on these features.

First, the compositions of a wire rod and a heat-treated part of the present disclosure, and reasons for limiting the contents of alloying elements of the wire rod and the heat-treaded part of the present disclosure will be described. Herein, "%" refers to weight % unless otherwise specified.

The wire rod and the heat-treated part of the present disclosure each include, by weight %, C: 0.3% to 0.5%, Si: 0.01% to 0.3%, Mn: 0.3% to 1.0%, Cr: 0.5% to 1.5%, Mo: 0.5% to 1.5%, V: 0.01% to 0.4%, and a balance of Fe and other impurities, and have a chemical composition satisfying the relational expression 1 below.

Composition [Wire Rod and Heat-Treated Part]

C: 0.3% to 0.5%

If the content of C is less than 0.3%, it is not easy to obtain sufficient material strength and secure sufficient hardenability after a final QT heat treatment. In addition, when the content of C exceeds 0.5%, there is a disadvantage in that carbides are excessively formed, causing a decrease in fatigue life. According to the present disclosure, the lower limit of the content of C is preferably 0.32%, and more preferably 0.35%. In addition, the upper limit of the content of C is preferably 0.47%, and more preferably 0.45%.

Si: 0.01% to 0.3%

Si is an element which is used for deoxidizing steel and is effective in securing strength through solid solution strengthening, but Si deteriorates cold forgeability. If the content of Si is less than 0.01%, it is not sufficient to secure strength through deoxidation and solid solution strengthening of steel. When the content of Si exceeds 0.3%, cold forgeability is lowered, making it difficult to form parts having complex shapes such as bolts.

Mn: 0.3% to 1.0%

Mn is an alloying element, which is advantageous for securing strength by improving hardenability of steel and has a function of increasing rollability and reducing brittleness. When Mn is added in an amount of less than 0.3%, it is difficult to secure sufficient strength. When Mn is added in an amount of greater than 1.0%, a hard microstructure may easily be formed, and MnS inclusion may be formed in a large amount during cooling after hot rolling, thereby deteriorating fatigue properties. Thus, it is necessary to limit the content of Mn. Preferably, the lower limit of the content of Mn may be set to be 0.5%, and the upper limit of the content of Mn may be set to be 0.95%.

Cr: 0.5% to 1.5%

Cr (chromium) is an element effective in improving the hardenability of steel together with Mn and improving the corrosion resistance of steel, and may thus be added in an amount of 0.5% or more. However, if the content of Cr is excessive, impact toughness decreases, and coarse carbides having a negative effect on the resistance to hydrogen delayed fracture are formed. Thus, the upper limit of the content of Cr may be set to be 1.5%.

Mo: 0.5% to 1.5%

Mo is an element effective in improving hardenability through strengthening by precipitation of fine carbides and solid solution strengthening, and the effect of Mo is much greater than the effect of Mn or Cr. When the content of Mo is less than 0.5%, it is not easy to secure strength after heat treatment because hardenability is not sufficiently secured through pearlite and bainite transformation delay. Conversely, when the content of Mo exceeds 2.0%, transformation to pearlite and bainite is excessively delayed, increasing the time for heat treatment and thus decreasing economical efficiency.

V: 0.01% to 0.4%

V is an element refining the microstructure of steel by forming fine carbides such as VC, VN, and V(C, N). When the content of V is less than 0.01%, the distribution of V precipitates in a base material is not sufficient to fix the grain boundaries of austenite, and thus grain coarsening occurs during reheating in a heat treatment process, thereby decreasing strength. Conversely, when the content of V exceeds 0.4%, coarse carbonitrides are formed, which adversely affects toughness. Therefore, in the present disclosure, it is preferable to adjust the content of V to be within the range of 0.01% to 0.4%.

According to the present disclosure, it is required to add Cr, Mo, and V to satisfy the relational expression 1 below.

$$1.5Cr+2.89Mo+7V \geq 3.563 \quad \text{[Relational expression 1]}$$

Here, Cr, Mo, and V each refer to the content thereof in weight %.

Fine carbides capable of trapping diffusible hydrogen are needed to improve resistance to hydrogen delayed fracture. Examples of fine carbides capable of trapping hydrogen include CrC, MoC, and VC, which respectively contain Cr, Mo, and V as main components. When the number of particles of these carbides is equal to or greater than a certain value, strength equal to or greater than 1400 MPa may be guaranteed, and the effect of trapping hydrogen may also be maximized. That is, when the contents of Cr, Mo, and V in steel for cold heading are adjusted to be certain values or more to satisfy the relational expression 1 above, the strength and the hydrogen delayed fraction resistance of the steel for cold heading may be improved.

[Wire Rod Manufacturing Method and Microstructure]

According to the present disclosure, first, a steel material having the composition described above is prepared, and the steel material is heated to a temperature of 900° C. to 1200° C. Thereafter, finish rolling is performed on the steel material at a temperature of 900° C. to 1100° C. The finish rolling is performed for grain refinement through dynamic recrystallization. If the finish rolling temperature is less than 900° C., a load on rolling equipment is significantly increased, and thus the lifespan of the rolling equipment may be markedly reduced. When the finish rolling temperature exceeds 1100° C., there is a problem in that the effect of refining grains decreases due to rapid grain growth at high temperature.

Through such finish hot rolling, a hot-rolled steel material having a microstructure with an average austenite particle size of 30 μm or less may be manufactured.

Next, according to the present disclosure, the hot-rolled steel material is coiled.

Thereafter, according to the present disclosure, the coiled hot-rolled steel material is cooled to room temperature with a cooling rate of 0.5° C./s to 1.0° C./s. Preferably, the lower limit of the cooling rate is set to be 0.52° C./s, more preferably 0.55° C./s, and most preferably 0.6° C./s. The cooling enables the manufacture of a high-strength wire rod having high resistance to hydrogen delayed fracture for cold heading, the high-strength wire rod having a microstructure containing, by area %, 1% to 15% martensite, 0.1% to 5% pearlite, and the balance of residual bainite.

Furthermore, in the wire rod of the present disclosure, the fraction of martensite formed along the grain boundaries of prior austenite in the martensite of the microstructure may be controlled to be 60% or more. The wire rod may then be subjected to softening heat treatment, cold forging, and QT heat treatment to prevent the formation of thin-film-shaped carbides along the grain boundaries of prior austenite and improve resistance to hydrogen delayed fracture by scattering and distributing spheroidized carbides inside and outside the grain boundaries.

[Heat-Treated Part Manufacturing Method and Microstructure]

In the present disclosure, the wire rod having the composition and the internal microstructure described above is subjected to a softening heat treatment at a temperature of 700° C. and 800° C. to lower the strength of the wire rod.

Next, according to the present disclosure, the softened wire rod is cold forged and then heated to a temperature of 850° C. to 1050° C., thereby manufacturing a part. The heating is performed to obtain a complete austenite microstructure. If the heating temperature is less than 850° C., spheroidal cementite does not re-dissolve, which causes deterioration of physical properties in a subsequent heat treatment, and if the heating temperature exceeds 1050° C., austenite grains grow excessively, which causes deterioration of physical properties in a subsequent heat treatment.

Thereafter, the heated part is quenched by immersing the heated part in oil having a temperature of 40° C. to 70° C. Owing to the quenching, the internal microstructure of the part becomes martensite.

Next, according to the present disclosure, the quenched part is tempered for 5000 seconds to 10000 seconds at a temperature of 500° C. to 650° C., thereby manufacturing a heat-treated part having a tempered martensitic microstructure.

In addition, the heat-treated part having a tempered martensitic microstructure, which is obtained through the QT heat treatment, may have a tensile strength of 1400 MPa or more and an impact toughness of 60 J or more.

MODE FOR INVENTION

Hereinafter, the present disclosure will be described in more detail through examples. It should be noted that the following examples are only for the understanding of the present disclosure, and are not intended to specify the scope of the present disclosure.

Example 1

Billets having the compositions shown in Table 1 were prepared.

TABLE 1

| | Composition (weight %) | | | | | | 1.5Cr + |
|---|---|---|---|---|---|---|---|
| Materials | C | Si | Mn | Cr | Mo | V | 2.89Mo + 7V |
| Inventive Material 1 | 0.38 | 0.13 | 0.52 | 1.22 | 0.64 | 0.12 | 4.5196 |
| Inventive Material 2 | 0.47 | 0.25 | 0.89 | 0.89 | 0.83 | 0.02 | 3.8737 |
| Inventive Material 3 | 0.42 | 0.22 | 0.73 | 0.81 | 0.75 | 0.08 | 3.9425 |
| Inventive Material 4 | 0.43 | 0.27 | 0.91 | 0.89 | 0.54 | 0.14 | 3.8756 |
| Inventive Material 5 | 0.32 | 0.23 | 0.52 | 0.57 | 1.37 | 0.15 | 5.8643 |
| Comparative Material 1 | 0.39 | 0.12 | 0.54 | 1.02 | 0.52 | 0.06 | 3.4528 |
| Comparative Material 2 | 0.46 | 0.26 | 0.87 | 0.72 | 0.8 | 0.02 | 3.532 |
| Comparative | 0.42 | 0.23 | 0.71 | 0.54 | 0.71 | 0.09 | 3.4919 |

TABLE 1-continued

| Materials | Composition (weight %) | | | | | | 1.5Cr + 2.89Mo + 7V |
|---|---|---|---|---|---|---|---|
| | C | Si | Mn | Cr | Mo | V | |
| Material 3 | | | | | | | |
| Comparative Material 4 | 0.42 | 0.25 | 0.83 | 0.53 | 0.59 | 0.15 | 3.5501 |
| Comparative Material 5 | 0.33 | 0.24 | 0.53 | 0.53 | 0.92 | 0.01 | 3.5238 |

TABLE 2

| Materials | Finish rolling Temp. (° C.) | Cooling Rate (° C./s) | Internal Microstructure | Fraction of Martensite along Grain Boundaries of Prior Austenite (%) | Samples |
|---|---|---|---|---|---|
| Inventive Material 1 | 950 | 0.5 | B (92%) + M (7.8%) + P (0.2%) | 81 | Inventive Sample 1 |
| | 850 | 0.05 | B (89%) + M (0.5%) + P (10.5%) | 58 | Comparative Sample 1 |
| Inventive Material 2 | 940 | 0.8 | B (94%) + M (5.0%) + P (1%) | 73 | Inventive Sample 2 |
| | 890 | 1.8 | B (96%) + M (3.6%) + P (0.4%) | 55 | Comparative Sample 2 |
| Inventive Material 3 | 920 | 0.52 | B (94%) + M (1.7%) + P (4.3%) | 68 | Inventive Sample 3 |
| Inventive Material 4 | 1050 | 0.9 | B (94%) + M (1.2%) + P (4.8%) | 65 | Inventive Sample 4 |
| Inventive Material 5 | 950 | 1 | B (85%) + M (14.9%) + P (0.1%) | 95 | Inventive Example 5 |
| Comparative Material 1 | 950 | 0.5 | B (96%) + M (0.9%) + P (3.1%) | 53 | Comparative Sample 3 |
| Comparative Material 2 | 950 | 0.7 | B (97%) + M (2.3%) + P (0.7%) | 56 | Comparative Sample 4 |
| Comparative Material 3 | 920 | 0.6 | B (95%) + M (1.3%) + P (3.7%) | 51 | Comparative Sample 5 |
| Comparative Material 4 | 950 | 0.8 | B (96%) + M (1.1%) + P (2.9%) | 48 | Comparative Sample 6 |
| Comparative Material 5 | 960 | 1 | B (90%) + M (9.5%) + P (0.5%) | 43 | Comparative Sample 7 |

The billets prepared with the compositions were heated to 900° C. to 1200° C., finish rolled under the conditions shown in Table 2, coiled, and cooled to room temperature under the conditions shown in Table 2. After the cooling, the microstructure of each steel material was measured. The measurement was performed by ASTM E8M and ASTM E23.

Results of the microstructure measurement showed that each of Inventive Samples 1-5 has a microstructure including 5% to 20% martensite, 0.1% to 1% pearlite, and a balance of bainite. However, Comparative Samples 3 to 7 having steel compositions outside the range of the present disclosure were outside the scope of the present disclosure in terms of microstructure fractions or the fraction of martensite formed along the grain boundaries of prior austenite.

Furthermore, in each of Comparative Samples 1 and 2 having steel compositions within the range of the present disclosure but not satisfying manufacturing process conditions of the present disclosure, the fraction of martensite formed along the grain boundaries of prior austenite in the martensite of the microstructure of a wire rod was less than 60%.

Example 2

After wire rods of Example 1 were machined to prepare tensile samples according to ASTM E 8, the samples were heated at 920° C. for 3600 seconds and then quenched by immersing the samples in 50° C. oil. Thereafter, the samples were tempered at 5550° C. for 6500 seconds, and then a tensile test was performed on the samples.

FIG. 1 is a graph illustrating the tensile strength of inventive samples and comparative samples with respect to tempering temperatures in the example of the present disclosure.

FIG. 2 is a graph illustrating the impact absorption energy of inventive samples and comparative samples with respect to tempering temperatures in the example of the present disclosure.

As shown in FIGS. 1 and 2, each of Inventive Samples 1 to 5 has a tensile strength of 1400 MPa or more and an impact toughness of 60 J or more. However, as the tempering temperature increases, the tensile strength of each of Comparative Samples 1 to 7 markedly decreases below 1400 MPa.

In particular, each of Comparative Samples 1 and 2, in which the fraction of martensite formed along the grain boundaries of prior austenite in the martensite of the microstructure of the wire rod is less than 60%, has a tensile strength of 1400 MPa or more but an impact toughness of less than 60 J after the QT heat treatment.

The present disclosure is not limited to the embodiments and examples described above, and various different forms may be manufactured according to the present disclosure. Those of ordinary skill in the art to which the present disclosure pertains will understand that other specific forms may be provided without departing from the technical spirit or features of the present disclosure. Therefore, the embodiments and examples described above should be considered in a descriptive sense only and not for purposes of limitation.

The invention claimed is:

1. A high-strength heat-treated part with high resistance to hydrogen delayed fracture, the high-strength heat-treated part having a chemical composition consisting of, by weight %, C: 0.3% to 0.5%, Si: 0.01% to 0.3%, Mn: 0.3% to 1.0%, Cr: 0.5% to 1.5%, Mo: 0.5% to 1.5%, V: 0.01% to 0.15%, and a balance of Fe and other impurities, the high-strength heat-treated part having a microstructure of tempered martensite, and the chemical composition satisfying the relational expression 1 below:

$$1.5Cr+2.89Mo+7V \geq 3.563 \quad \text{[Relational expression 1]}$$

where Cr, Mo, and V each refer to a content thereof in weight %.

2. The high-strength heat-treated part of claim 1, wherein the high-strength heat-treated part has a tensile strength of 1400 MPa or more and an impact toughness of 60 J or more.

* * * * *